US008399783B2

(12) United States Patent
Konno et al.

(10) Patent No.: US 8,399,783 B2
(45) Date of Patent: Mar. 19, 2013

(54) MULTI-DIRECTIONAL SWITCH DEVICE

(75) Inventors: Satoru Konno, Miyagi-Ken (JP); Mikio Sasaki, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 300 days.

(21) Appl. No.: 12/859,062

(22) Filed: Aug. 18, 2010

(65) Prior Publication Data

US 2011/0042189 A1 Feb. 24, 2011

(30) Foreign Application Priority Data

Aug. 20, 2009 (JP) ..... 2009-191051

(51) Int. Cl.
*H01R 13/70* (2006.01)

(52) U.S. Cl. ..... 200/5 R; 200/513; 200/517; 200/553

(58) Field of Classification Search ..... 200/1 B, 200/5 R, 5 A, 339, 553, 275, 512–513, 515, 200/517
See application file for complete search history.

(56) References Cited

U.S. PATENT DOCUMENTS

| | | | | |
|---|---|---|---|---|
| 5,115,108 | A * | 5/1992 | Ogawa et al. | 200/1 B |
| 5,426,275 | A * | 6/1995 | Maeda et al. | 200/553 |
| 6,737,592 | B1 * | 5/2004 | Hoang et al. | 200/1 B |
| 7,060,920 | B2 * | 6/2006 | Serizawa et al. | 200/200 |

FOREIGN PATENT DOCUMENTS

| | | |
|---|---|---|
| JP | 8-287787 | 11/1996 |
| JP | 2000-11807 | 1/2000 |

* cited by examiner

*Primary Examiner* — Xuong Chung Trans
(74) *Attorney, Agent, or Firm* — Brinks Hofer Gilson & Lione

(57) ABSTRACT

A multi-directional switch device includes: an operation member; an actuator which is applied with an operation force from the operation member; a plurality of rubber contacts which is pressed down by the actuator; and a plurality of fixed contacts to or from which the rubber contacts are respectively movable close or away, wherein the multi-directional switch device performs a switching operation in such a manner that a combination of a pair of two rubber contacts is selected from the plurality of rubber contacts in response to an operation direction, and both of the two rubber contacts are pressed down so as to respectively come into contact with the corresponding fixed contacts.

6 Claims, 3 Drawing Sheets

MULTI-DIRECTIONAL SWITCH DEVICE

CROSS REFERENCE TO RELATED APPLICATIONS

The present application contains subject matter related to and claims priority to Japanese Patent Application JP 2009-191051 filed in the Japanese Patent Office on Aug. 20, 2009, the entire contents of which is incorporated herein by reference.

BACKGROUND

1. Technical Field

The present disclosure relates to a multi-directional switch device which performs a switching operation when both of two rubber contacts are pressed down to be turned on, and is very suitable as, for example, a mirror angle control switch of a vehicle.

2. Related Art

As multi-directional switch devices, for some time, a four-directional switch device having a contact structure shown in FIG. 5 has been known (for example, refer to Japanese Unexamined Patent Application Publication No. 08-287787). In FIG. 5, a contact sheet member 21 is placed on a circuit board 20. The contact sheet member 21 is obtained by forming swollen rubber contacts 22 in a protruding manner at a plurality of positions of an electrically insulated elastic sheet formed of silicon rubber, and a movable contact 22*a* is provided inside each of the rubber contacts 22. Although the two adjacent rubber contacts 22 are shown in FIG. 5, eight rubber contacts 22 are dispersed in a protruding manner on the substantially same circumference of the contact sheet member 21, and the movable contact 22*a* of each of the rubber contacts 22 is opposite each of fixed contacts 23 installed on the circuit board 20 so as to be movable close thereto or away therefrom. Generally, when a top portion 22*b* of the rubber contact 22 is pressed down by a predetermined stroke, a skirt portion 22*c* is buckled and deformed (reversed) to generate a click feeling, and the movable contact 22*a* comes into contact with the fixed contact 23 to be turned on.

In addition, in FIG. 5, a driving body 24 or a pressure body 25 is disposed as an actuator for pressing and driving the rubber contact 22. The position of the driving body 24 is regulated by a guide wall 26 which is integrated with a housing (not shown). The pressure body 25 is mounted onto the top portion 22*b* of the rubber contact 22, and the pressure body 25 is pressed down by the driving body 24. That is, when a user presses down an operation member (not shown) in a desired direction, since the driving body 24 located in the desired direction is pressed down, the pair of rubber contacts 22 selected in response to the operation direction is pressed down by the pressure body 25. Since all of the rubber contacts 22 are formed in the same shape, the pair of pressed rubber contacts 22 generates a click feeling at almost the same time, and is turned on. When the pair of two rubber contacts is electrically connected to the corresponding fixed contacts 23, a predetermined switching operation is performed.

Accordingly, the user is able to selectively perform four types of different switching operations in response to a direction in which the operation member is pressed down. For example, in the case of a mirror angle control switch of a vehicle, the user is able to change a mirror in a desired direction (any one direction in the up/down and left/right directions) by pressing down the operation member in the desired direction. In addition, when the operation force is removed, since the buckled and deformed skirt portion 22*c* returns to its original shape due to its elasticity, the movable contact 22*a* is separated from the fixed contact 23 so that the rubber contact 22 is automatically turned off. Accordingly, the driving body 24 or the pressure body 25 is lifted up to the original height position.

However, in the multi-directional switch device of the related art adopting the contact structure shown in FIG. 5, when the height positions of the pair of two rubber contacts 22 in a non-operation state are not equal to each other due to a variation in manufacture, one rubber contact may be buckled and deformed (reversed) earlier than the other rubber contact in an operation state. In addition, even when the height positions of the two rubber contacts 22 in a non-operation state are set to be equal to each other, if the user presses the edge thereof so that an operation force is applied to a position close to any one of the rubber contacts, the other contact may be buckled and deformed earlier than the one rubber contact. Likewise, even when there is a difference in the reversing timing of the pair of two rubber contacts 22, a small difference in time does not cause a problem if the operation force is strong. However, if the operation force is weak, there is a possibility that the operation force for the operation member is removed at the point in time when the user feels the click feeling generated from the one rubber contact buckling and deforming at the first time. In this case, since the other rubber contact is not turned on, the switching operation is not performed.

Therefore, when the reversing timings of the pair of two rubber contacts 22 are deviated from each other in a contact structure shown in FIG. 5, an erroneous operation easily occurs, which leads to deterioration in operability and the user's mistake on the judgment of malfunction of the contact. In addition, if the operation force is strong, even when the normal operation state is perceived, since the click feeling is intermittently generated, the operation feeling becomes worse.

SUMMARY

A multi-directional switch device includes: an operation member; an actuator which is applied with an operation force from the operation member; a plurality of rubber contacts which is pressed down by the actuator; and a plurality of fixed contacts to or from which the rubber contacts are respectively movable close or away, wherein the multi-directional switch device performs a switching operation in such a manner that a combination of a pair of two rubber contacts is selected from the plurality of rubber contacts in response to an operation direction, and both of the two rubber contacts are pressed down so as to respectively come into contact with the corresponding fixed contacts, and wherein one of the pair of two rubber contacts is formed in a shape of generating a click feeling while being buckled and deformed during the pressing operation, the other rubber contact is formed in a shape of not generating a click feeling or generating a click feeling sufficiently weaker than that of the one rubber contact during the pressing operation, and when both of the two rubber contacts are pressed down, the other rubber contact comes into contact with the corresponding fixed contact earlier than the one rubber contact.

In the multi-directional switch device with such a configuration, when a user presses down the operation member in a desired direction, two rubber contacts selected in response to the operation direction are pressed down by the actuator. At this time, the other rubber contact is turned on without substantially or completely generating the click feeling earlier than the one rubber contact generating a clear click feeling.

When the user feels a clear click feeling, both of the two rubber contacts are turned on. That is, in the multi-directional switch device, the switching operation is not performed until a clear click feeling is generated during the pressing operation, and the switching operation is performed at the point in time when the clear click feeling is generated. Accordingly, an erroneous operation hardly occurs, and operability is satisfactory. In addition, since there is no concern in that the clear click feeling is intermittently generated during the pressing operation, the operation feeling becomes satisfactory. Further, assuming that one rubber contact is referred to as a click generating type rubber contact, and the other rubber contact is referred to as a non-click generating type rubber contact, for example, the skirt portion of the periphery of the top portion of the click generating type rubber contact is formed into a conical surface having an inverse V-shaped section, and the skirt portion of the non-click generating type rubber contact is formed into a cylindrical surface substantially having an inverse U-shaped section.

BRIEF DESCRIPTION OF THE DRAWINGS

FIG. 3 is an explanatory diagram of a main part showing a state where two rubber contacts of FIG. 2 are pressed down and one of them is turned on.

FIG. 4 is an explanatory diagram of a main part showing a state where two rubber contacts of FIG. 2 are pressed down and all of them are turned on.

DESCRIPTION OF EXEMPLARY EMBODIMENTS

Figure 1:
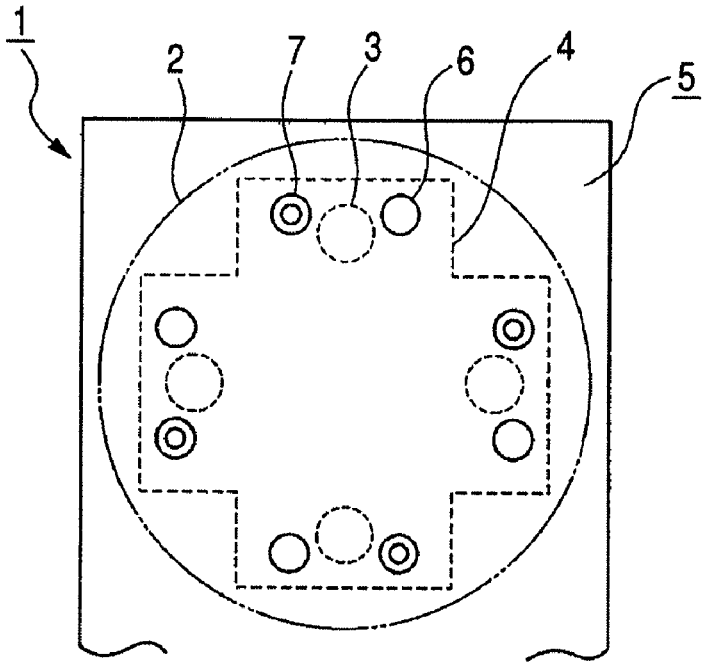
FIG. 1 is an explanatory diagram showing a plane structure of a multi-directional switch device according to an embodiment of the invention.

Hereinafter, an embodiment of the invention will be described with reference to FIGS. 1 to 4. A multi-directional switch device 1 shown in the drawings is used as a mirror angle control switch of a vehicle, and four types of switching operations can be selectively performed in response to the operation direction in order to control the mirror angle in four different directions.

The multi-directional switch device 1 mainly includes an operation member 2, a driving body 3 and a pressure body 4 which are applied with an operation force from the operation member 2, two types of rubber contacts 6 and 7 which are dispersed in a protruding manner at four positions in a contact sheet member 5, and fixed contacts 9 which are installed on a circuit board 8 so as to correspond to the rubber contacts 6 and 7. The operation member 2 can be tilted by selectively pressing down four positions located at the same interval in the outer peripheral portion thereof. The driving body 3 and the pressure body 4 are actuators for pressing and driving the rubber contacts 6 and 7. The contact sheet member 5 is formed by dispersing the swollen rubber contacts 6 and 7 in a protruding manner in an insulating elastic sheet formed of silicon rubber or the like, and the contact sheet member 5 is placed on the circuit board 8. In addition, the operation member 2 presses down the pressure body 4 via the driving body 3 during the operation, and the pressure body 4 presses down both of two rubber contacts 6 and 7 selected in response to the operation direction so as to come into contact with the corresponding fixed contact 9, thereby performing a predetermined switching operation.

As shown in FIG. 1, in the contact sheet member 5, two types of rubber contacts 6 and 7 (which are eight in total) are alternately provided in a protruding manner on the substantially same circumference, and two adjacent rubber contacts 6 and 7 among them make a pair. That is, in the contact sheet member 5, two types of rubber contacts 6 and 7 are disposed as a pair at four positions at the same interval therebetween. Then, as shown in FIG. 2, movable contacts 6*a* and 7*a* respectively provided inside the rubber contacts 6 and 7 face the corresponding fixed contacts 9 so as to be movable close thereto or away therefrom.

When two types of rubber contacts 6 and 7 are described, one rubber contact 6 is a click generating type, and the other rubber contact 7 is a non-click generating type. In the click generating type rubber contact 6, a skirt portion 6*c* of the periphery of a top portion 6*b* is formed into a conical surface having an inverse V-shaped section. When the top portion 6*b* is pressed down by a predetermined stroke, the skirt portion 6*c* is buckled and deformed (reversed) to thereby generate a click feeling, and the movable contact 6*a* comes into contact with the corresponding fixed contact 9 to be turned on. In addition, in the non-click generating type contact 7, a skirt portion 7*c* of the periphery of a top portion 7*b* is substantially formed into a cylindrical surface having an inverse U-shaped section. When the top portion 7*b* is pressed down by a predetermined stroke so that the skirt portion 7*c* of the periphery of the top portion 7*b* is gradually bent so as to be depressed inward in accordance with the operation of pressing down the top portion 7*b*, the movable contact 7*a* comes into contact with the corresponding fixed contact 9 to be turned on without substantially (or completely) generating the click feeling. In addition, the top portion 7*b* of the non-click generating type rubber contact 7 is formed as a secondary hollow deformation portion which is easily elastically deformable so as not to hinder an overstroke.

Figure 2:
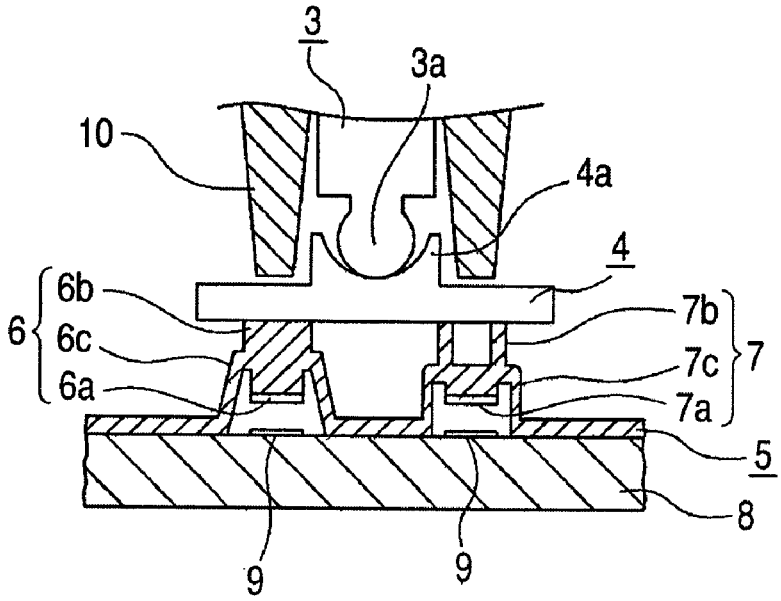
FIG. 2 is an explanatory diagram of a main part showing a non-operation state of a pair of two rubber contacts disposed in the multi-directional switch device.

As shown in FIG. 2, a pair of two types of rubber contacts 6 and 7 is formed to have the same height in a non-operation state. The operation force required for turning on the non-click generating type rubber contact 7 is set to be weaker than the operation force required for turning on the click generating type rubber contact 6. In addition, in consideration of the substantially same pressing force applied to the pair of rubber contacts 6 and 7, the driving body 3 and the pressure body 4 are disposed between the operation member 2 and the contact sheet member 5. For this reason, when the pair of rubber contacts 6 and 7 is pressed down by the pressure body 4, the non-click generating type rubber contact 7 is turned on earlier than the click generating type rubber contact 6.

Figure 3:
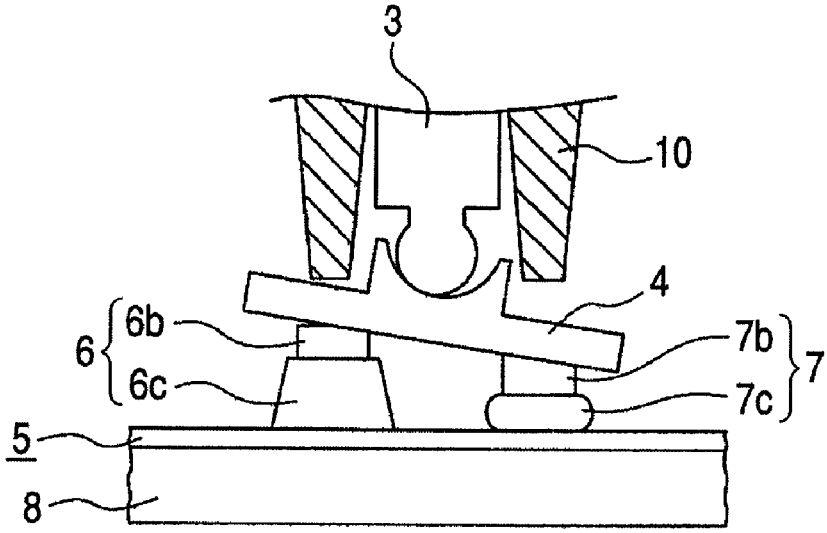

That is, the pressure body 4 is mounted onto both rubber contacts 6 and 7 so as to bridge the top portions 6*b* and 7*b* of the pair of rubber contacts 6 and 7, and the pressure body 4 is provided with a receiving portion 4*a* having a spherical surface and equally distanced from both rubber contacts 6 and 7. In addition, since the spherical end 3*a* of the driving body 3 comes into slidably press contact with the receiving portion 4*a*, the pressure body 4 is tiltably supported by the driving body 3. Accordingly, when a user presses down the operation member 2 so that the spherical end 3*a* of the driving body 3 presses down the pressure body 4, a substantially equal pressing force is applied to the pair of two rubber contacts 6 and 7. In addition, although the pressing amounts of the top portions 7*b* and 6*b* are different as shown in FIG. 3 so that the rubber contact 7 is turned on earlier than the rubber contact 6 during the pressing operation, since the pressure body 4 is tiltable with respect to the driving body 3, even when there is a variation in the height position between the top portions 7*b* and 6*b*, the pressure body 4 smoothly moves in a following manner. Further, a guide wall 10 for regulating the position of the driving body 3 is integrated with a housing (not shown).

Next, the operation of the multi-directional switch device 1 with such a configuration will be described. As shown in FIG. 2, since the height positions of the pair of two types of rubber contacts 6 and 7 are equal in a non-operation state, the pressure body 4 extends so as to be substantially parallel to the circuit board 8. At this time, since the movable contacts 6*a* and 7*a* of the rubber contacts 6 and 7 are separated from the corresponding fixed contacts 9, all of the rubber contacts 6 and 7 are turned off.

In this state, when the user presses down the operation member 2 in a desired direction, since the driving body 3 located at the desired direction is pressed down, the pair of rubber contacts 6 and 7 selected in response to the operation direction are pressed down by the pressure body 4. At this time, the pressing force applied to two rubber contacts 6 and 7 is substantially equal, but the operation force of the non-click generating type rubber contact 7 is weaker than that of the click generating type rubber contact 6. For this reason, as shown in FIG. 3, first, the skirt portion 7*c* of the rubber contact 7 is largely bent and comes into contact with the rubber contact 9 which is opposite to the movable contact 7*a*. That is, the rubber contact 7 is turned on earlier than the rubber contact 6. In this stage, since the rubber contact 6 is still turned off, the switching operation is not performed. The rubber contact 7 is turned on without substantially (or completely) generating a click feeling. Meanwhile, since the hollow top portion (secondary deformation portion) 7*b* is easily elastically deformed by the overstroke of the rubber contact 7, the user conducts the pressing operation without an uncomfortable feeling so that the driving body 3 and the pressure body 4 are further pressed down.

Figure 4:
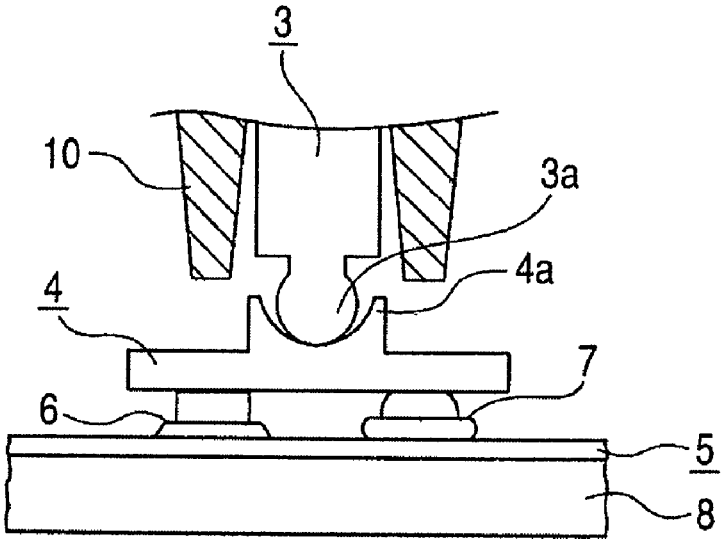
Figure 5:
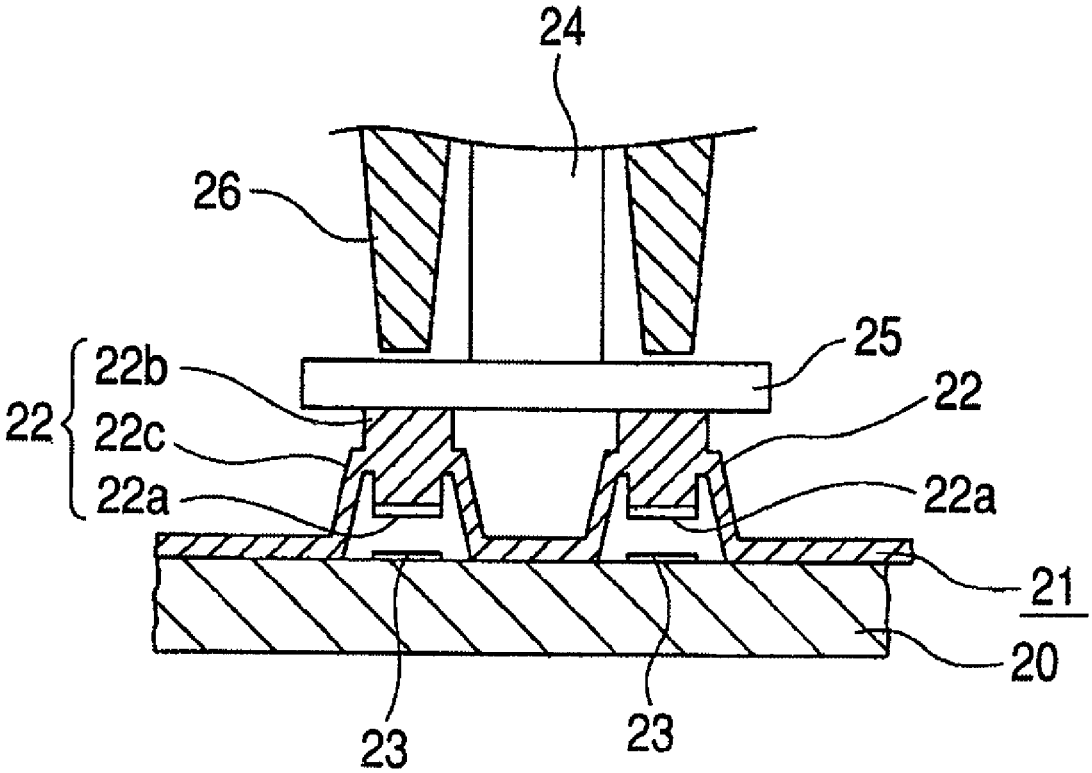
FIG. 5 PRIOR ART
FIG. 5 is an explanatory diagram showing a pair of two rubber contacts disposed in a multi-directional switch device according to the related art.

In addition, at the point in time when the top portion 6*b* of the rubber contact 6 (which is turned off) is pressed down at a predetermined stroke by the pressure body 4, the skirt portion 6*c* is buckled and deformed to thereby generate a click feeling, and the movable contact 6*a* comes into contact with the corresponding fixed contact 9 to be turned on (refer to FIG. 4). As a result, the pair of two rubber contacts 6 and 7 is electrically connected to the corresponding fixed contacts 9, thereby performing a predetermined switching operation. That is, the user is able to selectively perform four different switching operations in response to the direction in which the operation member 2 is pressed down. Specifically, the user is able to change the direction of the mirror to a desired direction (any one direction in the up/down and left/right directions) by pressing down the operation member 2 in the desired direction.

Further, since the skirt portion 6*c* and 7*c* or the top portion 7*b* return to their original shapes due to their elasticity when the operation force for the operation member 2 is removed, the movable contacts 6*a* and 7*a* are separated from the fixed contacts 9, and the rubber contacts 6 and 7 are automatically turned off as shown in FIG. 2. In addition, as the rubber contacts 6 and 7 return to their original shapes, the driving body 3 or the pressure body 4 can be lifted up to the original height position.

As described above, in the multi-directional switch device 1 according to the embodiment, one of the pair of two rubber contacts 6 and 7 is a click generating type and the other thereof is a non-click generating type. Since the non-click generating type rubber contact 7 is turned on earlier than the click generating type rubber contact 6 when all of the pair of rubber contacts 6 and 7 are pressed down, both rubber contacts 6 and 7 are turned on when the user feels a clear click feeling. That is, in the multi-directional switch device 1, the switching operation is not performed until a clear click feeling is generated during the pressing operation, and the switching operation is performed at the point in time when a clear click feeling is generated. Accordingly, an erroneous operation hardly occurs, and operability is satisfactory. In addition, since there is no concern that the clear click feeling is intermittently generated during the pressing operation, the operation feeling becomes satisfactory.

Particularly, in the embodiment, the operation force required for turning on the non-click generating type rubber contact 7 is set to be weaker than the operation force required for turning on the click generating type rubber contact 6. In addition, since the substantially equal pressing force is set to be applied to both rubber contacts 7 and 6, it is possible to reliably turn on both rubber contacts 7 and 6 in a sequential order from the non-click generating type rubber contact 7 and the click generating type rubber contact 6 during the pressing operation. However, even when the operation forces of two rubber contacts 7 and 6 are equal to each other, if the pressing force is allowed to be applied to a position close to the non-click generating type rubber contact 7, it is possible to reliably and sequentially turn on the non-click generating type rubber contact 7 and the click generating type rubber contact 6 during the pressing operation.

Further, in the multi-directional switch device 1 according to the embodiment, the non-click generating type rubber contact 7 is provided with the hollow top portion 7*b* as the secondary deformation portion which is elastically deformed by the over stoke during the pressing operation. When the pressing operation is performed while elastically deforming the top portion 7*b* (secondary deformation portion), the click generating type rubber contact 6 is turned on. For this reason, since the pressing operation is easily performed without an uncomfortable feeling even after the non-click generating type rubber contact 7 is turned on, it is possible to smoothly perform the pressing operation of sequentially turning on the pair of rubber contacts 7 and 6. Further, since the clear click feeling generated by the click generating type rubber contact 6 is hardly damaged by the non-click generating type rubber contact 7 which is turned on, the satisfactory click feeling can be expected.

Furthermore, in the above-described embodiment, since the spherical end 3*a* of the driving body 3 comes into press-slidable contact with the receiving portion 4*a* of the pressure body 4 mounted onto the pair of two rubber contacts 6 and 7, the pressure body 4 is tiltably supported to the driving body 3. For this reason, the tilting movement of the pressure body 4 can smoothly follow the up/down movement of each of the top portions 6*b* and 7*b* of the rubber contacts 6 and 7, and the pressing force can be applied to the predetermined position (receiving portion 4*a*) of the pressure body 4 at all times, thereby easily improving the reliability. However, the structure of the actuator for pressing and driving the rubber contacts 6 and 7 is not limited to the above-described embodiment. For example, a driving body protruding from an operation member may be combined with a pressure body, or a driving body tilting together with a pressure body may be used.

Moreover, in the above-described embodiment, the multi-directional switch device (four-directional switch device) has been described as the mirror angle control switch of the vehicle. However, if a multi-directional switch device performs a switching operation by a pressing operation of pressing down a pair of two rubber contacts to be turned on, the advantage of the above-described embodiment can be expected by applying the invention to the multi-direction switch device.

It should be understood by those skilled in the art that various modifications, combinations, sub-combinations and alterations may occur depending on design requirements and other factors insofar as they are within the scope of the appended claims of the equivalents thereof.

What is claimed is:

1. A multi-directional switch device comprising:

an operation member;

an actuator to which a multi-directional operation force is applied from the operation member, wherein the multi-directional operation force comprises pressing the actuator to actuate angles tilting in directions comprising forward, backward, to the right, and to the left;

at least four rubber contact pairs, wherein:

a first rubber contact pair is oppositely disposed across from a second rubber contact pair to enable forward or backward angles tilting direction, respectively; and a third rubber contact pair is oppositely disposed across from a fourth rubber contact pair to enable to the right or to the left angles tilting direction, respectively;

each of the first, the second, the third and the fourth rubber contact pairs is pressed down by the corresponding multi-directional operation force applied to the actuator; and at least four corresponding fixed contact pairs, to or from which the at least four corresponding rubber contact pairs are respectively movable closer to or away from each other, wherein the multi-directional switch device performs a switching operation according to the corresponding multi-directional operation force applied to the actuator, in such a manner that one of the corresponding first, second, third or fourth rubber contact pair is simultaneous pressed down so as to respectively come into contact with the corresponding fixed contact pair, and wherein during the pressing operation:

one rubber contact of the corresponding first, second, third or fourth rubber contact pair is deformed and buckled in such a shape to generate a click feeling, and another rubber contact of the same corresponding first, second, third or fourth rubber contact pair is simultaneously deformed and buckled in such a shape that it either does not generate the click feeling, or generates a click feeling which is sufficiently weaker than that of the one rubber contact during the pressing operation;

the one rubber contact of the corresponding first, second, third or fourth rubber contact pair comes into contact with a corresponding fixed contact earlier than the another rubber contact.

2. The multi-directional switch device according to claim 1, wherein the another rubber contact is provided with a secondary deformation portion which is elastically deformed by an overstroke during the pressing operation, and when the pressing operation is performed while elastically deforming the secondary deformation portion, the one rubber contact comes into contact with the corresponding fixed contact.

3. The multi-directional switch device according to claim 1, wherein an operation force required for turning on the another rubber contact is set to be weaker than an operation force required for turning on the one rubber contact, and the pressing forces applied to the two rubber contacts are set to be substantially equal to each other.

4. The multi-directional switch device according to claim 1, wherein the actuator includes a pressure body which is mounted directly above both rubber contacts of each of the first, the second, the third and the fourth rubber contact pairs so as to bridge top portions of the corresponding pair of the two rubber contacts, and a corresponding driving body for each of the first, the second, the third and the fourth rubber contact pairs, wherein each of the corresponding driving body is mounted at a corresponding predetermined position of the pressure body, which pressure body is pressed down by the operation member, and wherein the pressure body tiltably supports the driving body using a guidable groove.

5. The multi-directional switch device according to claim 4, wherein each corresponding driving body comprises a spherical end which is correspondingly supported by the pressure body.

6. The multi-directional switch device according to claim 1, further comprising:

a contact sheet member which is provided with two rubber contacts for each corresponding first, the second, the third and the fourth rubber contact pairs dispersed on a substantially same circumference; and a circuit board which is provided with fixed contacts for each corresponding first, the second, the third and the fourth rubber contact pairs, to or from which the rubber contact pairs are respectively movable closer to or away from each other, wherein four types of switching operations corresponding to the forward, backward, to the right, and to the left angles tilting directions of a mirror are selectively performed in response to the operation direction.

* * * * *